US005939994A

United States Patent [19]

Meier et al.

[11] Patent Number: 5,939,994

[45] Date of Patent: Aug. 17, 1999

[54] AUTOMATIC SURVEILLANCE DEVICE

[75] Inventors: Otto Meier, Rüti; Peter Gruber, Stäfa; Bernhard Durrer, Wollerau, all of Switzerland

[73] Assignee: Cerberus AG, Switzerland

[21] Appl. No.: 08/744,596

[22] Filed: Nov. 6, 1996

[30] Foreign Application Priority Data

Nov. 6, 1995 [EP] European Pat. Off. ..... 95117405

[51] Int. Cl.[6] ..... G08B 23/00

[52] U.S. Cl. ..... 340/693; 340/628; 340/630; 340/632; 361/624

[58] Field of Search ..... 340/693, 541, 340/584, 577, 286.05, 630, 628; 361/679, 748, 752, 624; 439/630, 637

[56] References Cited

U.S. PATENT DOCUMENTS 4,934,961 6/1990 Piorunneck et al. ..... 439/637
5,154,644 10/1992 Kiat-Hup et al. ..... 439/630
5,486,816 1/1996 Ariga et al. ..... 340/630
5,596,314 1/1997 Goldstein ..... 340/628
5,629,831 5/1997 Eggert et al. ..... 361/624

FOREIGN PATENT DOCUMENTS 9210856 10/1992 Germany .
4400915 4/1995 Germany .

*Primary Examiner*—Jeffery A. Hofsass
*Assistant Examiner*—Daretta Woods
*Attorney, Agent, or Firm*—Baker & Botts, L.L.P.

[57] ABSTRACT

A surveillance device, e.g. a fire alarm or an intrusion detector, includes a mount having a connector block, and an insert having a sensor assembly, a printed circuit board with evaluation electronics, and an electrical contact to the connector block. The printed circuit board is a plug-in card with a contact strip. For insertion, with the mount disposed at a horizontal surface, for example, the insert is first moved vertically and then displaced horizontally. In the horizontal displacement, an electrical connection is established between the contact strip and the connector block.

20 Claims, 2 Drawing Sheets

AUTOMATIC SURVEILLANCE DEVICE

TECHNICAL FIELD

The present invention relates to an automatic surveillance device and, more specifically, to its mounting.

BACKGROUND OF THE INVENTION

Automatic surveillance devices such as, e.g., fire alarms, intrusion detectors, gas detectors and radiation detectors typically are designed for installation at a supporting surface, with a mount component being fastened to the surface and an insert component being fastened detachably to the mount. Included in the insert is a sensor assembly, e.g., for light, heat, gas or hazardous radiation, along with sensor-signal evaluation electronics on a circuit board. An electrical connection is established between the insert and the mount. For protection of the mounted combination, a cover may be installed.

A device of this type in the form of a fire alarm is described in German Patent Document DE-U-9210856.3. The fire alarm has an alarm mount with a connector block, and an alarm insert which includes a sensor assembly, and a printed circuit board with evaluation electronics and with a plug for electrical connection to the connector block. The alarm mount, e.g. consisting of a simple injection-molded part, has a multi-polar connector block with plug sockets, and the alarm insert has a contact pin strip with corresponding contact pins which are engaged with the connector block when the alarm (i.e., the alarm insert together with the alarm cover) is inserted. The alarm insert can be rotated in the circumferential alarm cover, and can be locked in its final position. For this purpose, the alarm insert has a circumferential side wall which functions as a centering ring. The alarm cover can be mechanically interlocked on the alarm mount, in that a locking cam formed on the alarm cover is guided in an obliquely extending gate guide in a locking gate when the alarm is inserted. The gate guide is disposed on the alarm cover such that, to establish contact, there is vertical lifting when the alarm is inserted and twisted in.

There is a risk of damage to the interlocking mechanism due to improper handling of this device. Also, because of the interlocking mechanism with locking gate and locking cam, and because of the way contact is made between the connector block and contact pins in a vertical lifting movement, the device is expensive to make in mass production.

It is especially the way contact is made in a vertical lifting movement which increases the manufacturing costs. This is due to considerable construction costs for bringing the contact pin strip by a first, rotational movement of the alarm into the correct position where it is in alignment with the connector block but still at a distance from the connector block, and then establishing electrical contact gently yet positively in the vertical lifting movement. Also, this type of contacting requires contact pins which are directed vertically upwards from the printed circuit board, making it necessary to mount a separate component on the printed circuit board in a separate manufacturing step.

SUMMARY OF THE INVENTION

In an improved surveillance device, e.g. a fire alarm, manufacturing costs are reduced without impairment of robustness and ease of handling of the device.

The printed circuit board in the insert component is designed as a "plug-in card" having a contact strip, and insertion of the insert in the mount component involves a vertical movement and a subsequent horizontal displacement. In the horizontal displacement, an electrical connection is established between a connector block on the mount and the contact strip. The vertical movement is perpendicular to a mounting face of the mount, and the horizontal movement is parallel to the mounting face.

The construction of the printed circuit board as a plug-in card is advantageous in that there is no need for a separate plug on the printed circuit board, so that expenditures for the plug and for device assembly are saved. With insertion by a vertical lifting movement and a subsequent horizontal displacement, the insert is no longer twisted but rather pushed in. This facilitates the handling of the insert and allows for simplified gate guides. As a result, the device is more robust in installation.

In a preferred embodiment, the mount and the insert have mutually corresponding guide features which guide the insert when it is pushed vertically into the mount. Preferably further, guide features guide the insert also in the horizontal displacement.

Preferably, the insert has a suitable contour at its side which bears the printed circuit board, and the mount has holding features which are adapted to the contour and into which the insert can be inserted in the vertical movement. Preferably in this respect, the insert has nose-like projections on the contour, and the mount has guide gates for the projections.

Preferably, on the contour of the insert and preferably in the region of the plug for the connector block, a coding feature is included which is specific to a type of insert and which ensures that only an insert of an intended type can be inserted into the correspondingly coded mount.

Preferably further, a cover is designed for engaging the insert so as to lock it in the mount and to secure it against unintended horizontal displacement. In this case, the insert without the cover is pushed vertically into the mount to a stop, and then is displaced laterally towards the connector block. The proper direction of displacement is readily apparent to the installer, namely for plugging the printed circuit board into the connector block. Free of the cover, visual monitoring of the insertion procedure is facilitated. When proper insertion has been ascertained, the cover is put in place.

DETAILED DESCRIPTION OF PREFERRED EMBODIMENTS

Figure 1:
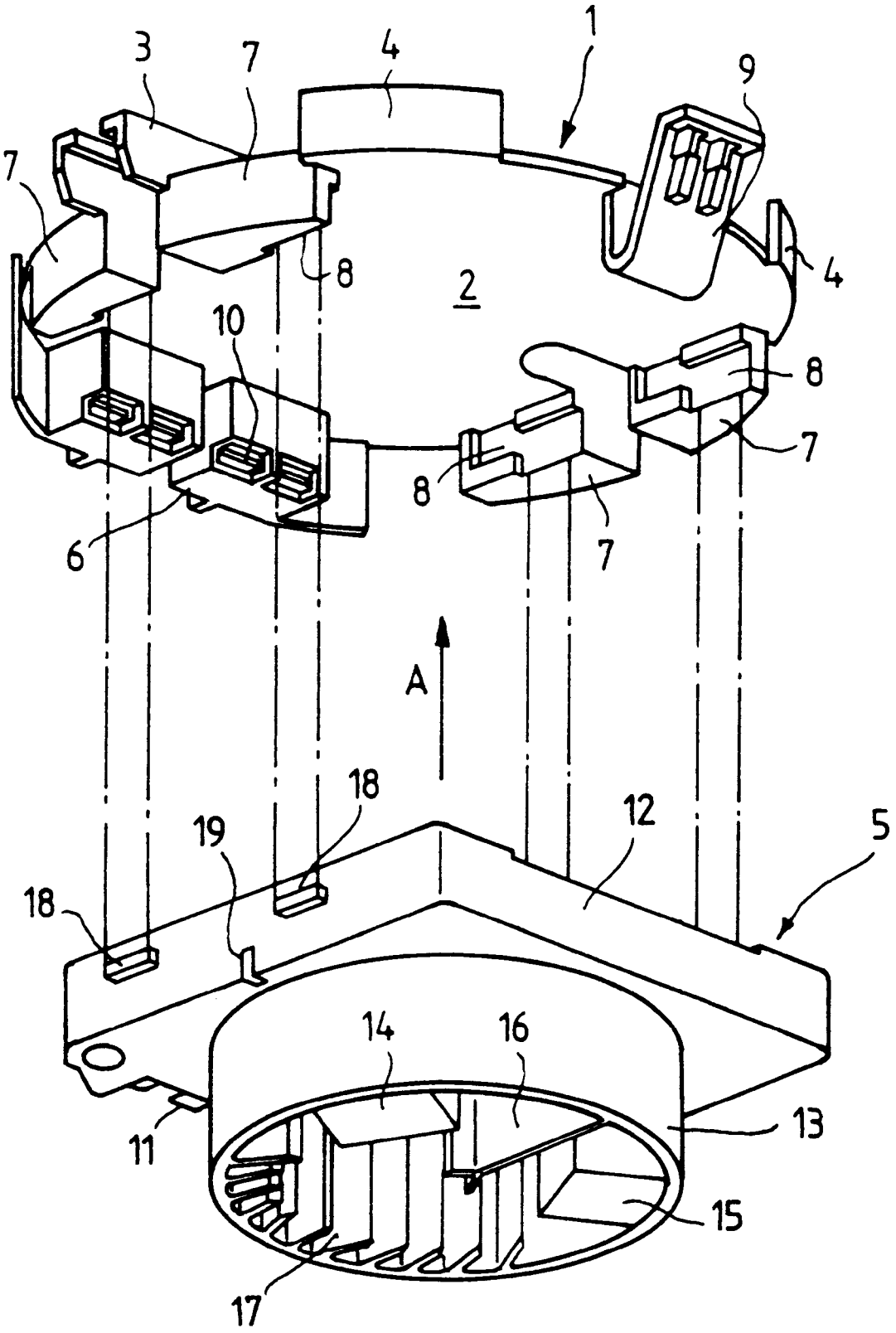
FIG. 1 is a perspective view of a fire alarm mount and an alarm insert positioned for insertion in the alarm mount.

FIG. 1 shows an alarm mount 1, e.g. as disposed at a ceiling either directly on a concealed box or in combination with a suitable support. The alarm mount 1 consists of a base in the form of a round plate 2 which, on its upper side facing towards the ceiling, has fastener rails 3 and an edge covering 4. On its lower face, which is designed for receiving the alarm insert 5, the alarm mount 1 has a guide feature for receiving the alarm insert 5 and a connector block 6. The guide feature consists of two mutually opposite guide blocks 7, with each block having two parts and with each part having a guide gate 8 on its inner wall. A clip 9 on the alarm mount 1 facilitates insertion of the insert 5 into the mount 1.

The connector block 6, which is disposed perpendicular to the guide blocks 7 and opposite the clip 9, has a contact receptacle strip 10 for receiving a contact strip 11 on the alarm insert 5, with the contact strip 11 extending parallel to the disc 2. The guide blocks 7, the clip 9 and the connector block 6 delimit the four sides of a rectangular socket for insertion of the alarm insert 5 in the direction of the arrow A. The distance between the receptacle strip 10 and the clip 9 is greater than the corresponding dimension of the alarm insert 5.

The alarm insert 5 has a rectangular base body 12 which has a sensor assembly on the side which faces away from the alarm mount 1 and which, on the side facing the alarm mount, has a printed circuit board (not shown) with evaluation electronics for the sensor signal. The printed circuit board is disposed parallel to the base body 12. It is designed as a plug-in card and has contact strip lamellae 11 which are integrated with the printed circuit. As shown and described in the following, the sensor assembly is for optical smoke detection. Other types, e.g. a heat sensor, are not precluded.

The sensor assembly is disposed in an opto-electronic measurement chamber 13 and includes a first casing 14 with a light source, a second casing 15 with a light receiver, a diaphragm 16, and a so-called "labyrinth" or light trap 17. The diaphragm 16 and labyrinth 17 prevent light rays from passing from the light source directly to the light receiver. The bottom of the measurement chamber 13 is covered by a lid (not shown). On its base body 12, and preferably in the region of the contact strip 11, the alarm insert 5 has a coding feature which is specific to the type of alarm insert for the alarm mount 1. For example, mechanical elements such as ribs or grooves can be included to ensure that the proper type of alarm insert 5 is installed in the alarm mount 1.

The side of the base body 12 with the printed circuit board is preferably box like, having at least three side walls which enclose the printed circuit board on corresponding sides for mechanical protection and electrical shielding of the board. At the fourth side wall, which is at least partially open, the contact strip 11 projects from the base body 12. Two guide noses 18 are disposed at two mutually opposite side walls of the base body 12 for engagement in the guide gates 8 of the guide blocks 7 on the alarm mount 1. The chain-dotted lines between the guide noses 18 and the guide gates 8 indicate the mutual position of these elements when the alarm insert 5 is being inserted into the alarm mount 1. The base body 12 has a reference mark 19.

The guide gates 8 are substantially L-shaped and have a vertical and a horizontal leg. When the alarm insert 5 is inserted into the alarm mount 1 in the direction of the arrow A, the guide noses 18 enter the vertical leg of the guide gates 8 to a stop. Then, by horizontal displacement, they enter the horizontal leg of the guide gates 8. Positive guidance of the noses 18 into the vertical leg is facilitated by the clip 9, as the vertical portion of the clip guides an edge of the base body 12.

Figure 2:
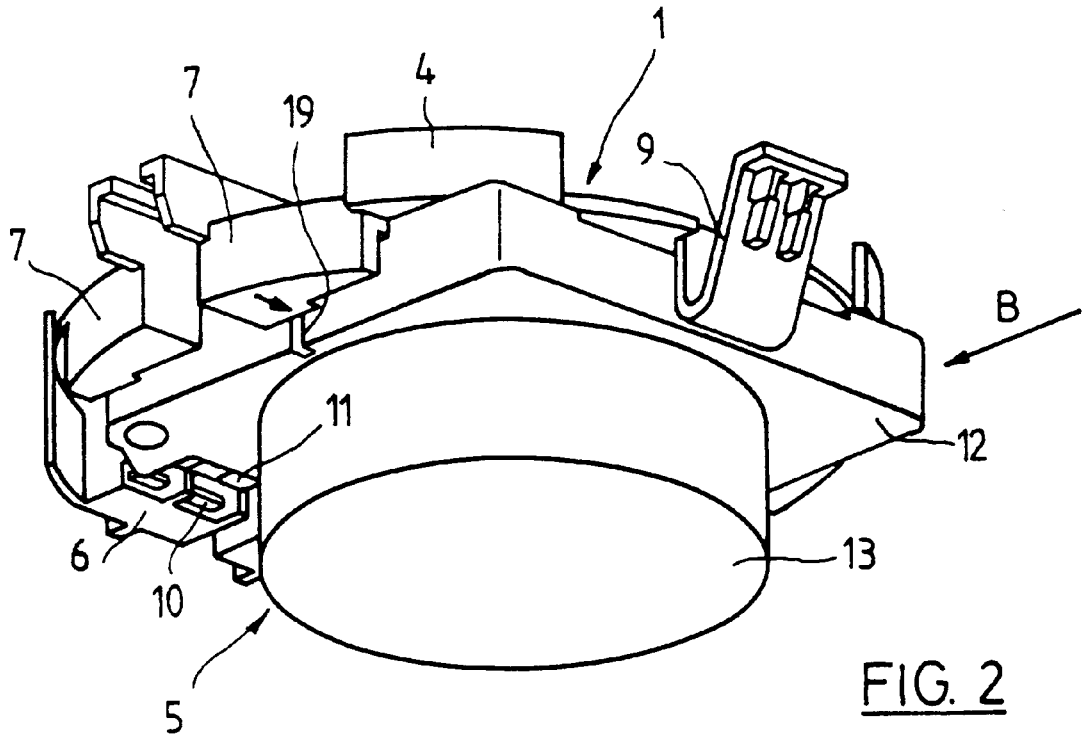
FIG. 2 is a perspective view of the fire alarm with the alarm insert in an intermediate position.

FIG. 2 illustrates a position of the alarm insert 5 in the alarm mount 1 after completion of the vertical movement. In this position, the reference mark 19 is lined up with a reference arrow on the guide block 7, and the alarm insert 5 abuts the clip 9. Vertically, the alarm insert 5 is now fully inserted into the alarm mount 1, but no electrical connection has been established as yet between the receptacle strip 10 of the connector block 6 and the contact strip 11.

The electrical connection is made in lateral displacement of the alarm insert 5 in the direction of the arrow B, whereby the contact strip 11 of the printed circuit board is pushed into the receptacle strip 10 of the connector block 6. In the final position illustrated by FIG. 3, the alarm insert 5 is secured in the alarm mount 1 by the guide noses 18 in the horizontal leg of the guide gates 8. The reference mark 19 is now displaced from the arrow on the guide block 7, and the clip 9 no longer abuts the alarm insert 5.

Figure 3:
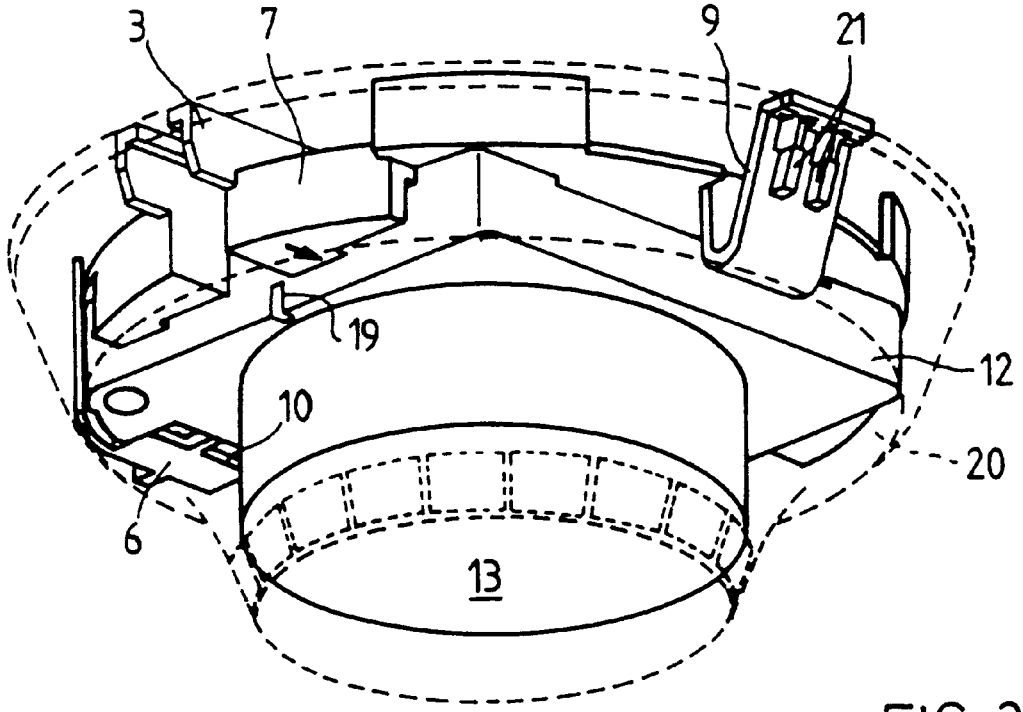
FIG. 3 is a perspective view of the complete fire alarm with the alarm insert fully inserted and with the alarm cover in place.

As the alarm insert 5 is inserted in the alarm mount 1 without the alarm cover, the insertion procedure can be monitored visually. The connector block 6 is in plain view, and so is the contact strip with the contact lamellae projecting laterally from the alarm insert 5. Thus, for insertion in the alarm mount 1, the correct position of the alarm insert 5 is plainly apparent to the installer. After insertion of the alarm insert 5, the alarm cover 20 which is drawn with broken lines in FIG. 3 is put in place and fastened. Preferably, this involves engaging or snapping the cover 20 into corresponding fastener elements on the alarm mount 1.

To this end, in the region of the connector block 6 and preferably at the level of the fastener rails 3, the alarm mount 1 has projections (not shown) which protrude radially from the plate 2 for engaging corresponding recesses in the alarm cover 20. The clip 9 is elastic and, on its outer leg, has projections 21 also for engaging corresponding recesses in the alarm cover 20. In placement, the alarm cover 20 is hooked up with the projections from the plate 2, and is then engaged with the projections 21 in a pivoting movement. For removal, pressure on the projections 21 releases the alarm cover 20.

The alarm cover is designed for locking the alarm insert 5 in the alarm mount 1 for securing the electrical connection between the receptacle strip 10 and the contact strip 11, thus preventing unintentional disconnection due to vibration, for example. To this end, the case of the alarm cover 20 is shaped such that the cover engages around the alarm insert 5 sufficiently tightly at a suitable location. In FIG. 3, this is the edge of the lower face of the base body 12 which bears the sensor assembly.

We claim:

1. An automatic surveillance device comprising:

mount having a connector block; and an insert for insertion into the mount at a mounting face of the mount and comprising a sensor and a printed circuit board including evaluation electronics for evaluating signals from the sensor, wherein the printed circuit board has an electrical contact which is configured and disposed for plug-in at the connector block to establish an electrical connection between the connector block and the evaluation electronics, and wherein the mount and the insert are configured for the insertion by a first movement of the insert in a direction substantially perpendicular to the mounting face, followed by a second movement of the insert which effects a lateral displacement of the insert relative to the mount in a direction substantially parallel to the mounting face.

2. The surveillance device according to claim 1, wherein the mount and the insert have mutually corresponding guidance features for guiding the insert in the movement.

3. The surveillance device according to claim 2, wherein the guidance feature on the insert is disposed at a side of the insert which comprises the printed circuit board.

4. The surveillance device according to claim 2, wherein the guidance feature on the insert comprises projections and the guidance feature on the mount comprises guide gates for the projections.

5. The surveillance device according to claim 2, wherein the guidance features further are for guiding the insert in the displacement.

6. The surveillance device according to claim 2, wherein the guidance feature on the mount comprises a holding feature for holding the insert, and wherein the insert is configured for engagement with the holding feature in the displacement.

7. The surveillance device according to claim 2, wherein the mount and the insert have coding features which permit insertion of an insert of an intended type and which prevent insertion of an insert of an unintended type.

8. The surveillance device according to claim 7, wherein the coding feature on the insert is disposed in a vicinity of the electrical contact.

9. The surveillance device according to claim 7, wherein the coding features comprise mechanical elements.

10. The surveillance device according to claim 9, wherein the mechanical elements comprise ribs and/or grooves.

11. The surveillance device according to claim 6, wherein the insert has a rectangular contour at a side adjacent to the mount, and wherein the holding feature is configured as two guide blocks disposed at two opposite sides of the insert.

12. The surveillance device according to claim 11, wherein the connector block is disposed at a side of the insert other than the two guide-block sides, and wherein the mount further comprises a guide clip for positioning the insert at its fourth side in the mount.

13. The surveillance device according to claim 1, further comprising a cover for protecting the mount and the insert in combination.

14. The surveillance device according to claim 13, wherein the cover is configured for placement after the insertion of the insert.

15. The surveillance device according to claim 14, wherein the cover is configured for locking the insert in the mount so as to prevent unintended displacement of the insert relative to the mount.

16. The surveillance device according to claim 13, wherein the cover is configured for engagement with the mount.

17. The surveillance device according to claim 16, wherein the cover is configured for snap engagement with the mount.

18. The surveillance device according to claim 12 and further comprising a cover for protecting the mount and the insert in combination, wherein the cover is configured for engagement with the guide clip of the mount.

19. The surveillance device according to claim 1, wherein the sensor assembly comprises a light sensor.

20. The surveillance device according to claim 1, wherein the sensor assembly comprises a heat sensor.

* * * * *